US009347715B2

(12) United States Patent
Schreiber et al.

(10) Patent No.: US 9,347,715 B2
(45) Date of Patent: May 24, 2016

(54) VAPOR COMPRESSION SYSTEM

(75) Inventors: Jeb Schreiber, Emigsville, PA (US); Jay A. Kohler, York, PA (US); Paul De Larminat, Nantes (FR); Mustafa Kemal Yanik, York, PA (US); William F. McQuade, New Cumberland, PA (US); Justin Kauffman, York, PA (US); Soren Bierre Poulsen, Rissle (DK); Lee Li Wang, Shanghai (CN); Satheesh Kulankara, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 1682 days.

(21) Appl. No.: 12/747,286

(22) PCT Filed: Jan. 9, 2009

(86) PCT No.: PCT/US2009/030592

§ 371 (c)(1),
(2), (4) Date: Sep. 3, 2010

(87) PCT Pub. No.: WO2009/089446

PCT Pub. Date: Jul. 16, 2009

(65) Prior Publication Data

US 2010/0326108 A1 Dec. 30, 2010

Related U.S. Application Data

(60) Provisional application No. 61/020,533, filed on Jan. 11, 2008.

(51) Int. Cl.
*F28F 25/06* (2006.01)
*F25B 39/02* (2006.01)
(Continued)

(52) U.S. Cl.
CPC ..... *F28F 25/06* (2013.01); *F25B 39/028* (2013.01); *F28D 3/02* (2013.01); *F28D 3/04* (2013.01);
(Continued)

(58) Field of Classification Search
CPC ..... F25B 1/10; F25B 5/00; F25B 23/006; F25B 39/02; F25B 39/022; F25B 39/024; F25B 39/028; F25B 41/00; F25B 41/04; F25B 41/065; F25B 2339/023; F25B 2339/02; F25B 2339/021; F25B 2339/022; F25B 2339/024; F25B 2339/0241; F25B 2239/0242; F25B 2400/16; F25D 17/02; F25D 23/006; F28F 25/06; F28F 9/22; F28D 3/02; F28D 3/04; F28D 7/16; F28D 21/0017; F28D 2021/0071
USPC ..... 62/79, 174, 180, 185, 188, 216, 221, 62/513, 515, 516, 517, 519, 527, 528, 98, 62/99, 218, 504
See application file for complete search history.

(56) References Cited

U.S. PATENT DOCUMENTS 939,143 A 11/1909 Lillie
2,012,183 A 8/1935 Carrier
(Continued)

FOREIGN PATENT DOCUMENTS

EP 0179225 A 4/1986
EP 1030154 A2 8/2000
(Continued)

OTHER PUBLICATIONS

Witt, "Spray Evaporator—Assembly and Instructions for the BVKF Models", Nov. 1, 1998, pp. 1-11, Figures p. 2.

*Primary Examiner* — Marc Norman
(74) *Attorney, Agent, or Firm* — McNees Wallace & Nurick LLC

(57) ABSTRACT

An evaporator (168) in a vapor compression system (14) (168) includes a shell (76), a first tube bundle (78); a hood (86); a distributor (80); a first supply line (142); a second supply line (144); a valve (122) positioned in the second supply line (144); and a sensor (150). The distributor (80) is positioned above the first tube bundle (78). The hood (88) covers the first tube bundle (78). The first supply line (142) is connected to the distributor (80) and an end of the second supply line (144) is positioned near the hood (88). The sensor (150) is configured and positioned to sense a level of liquid refrigerant (82) in the shell. The valve (122) regulates flow in the second supply line in response to the level of liquid refrigerant (82) from the sensor (150).

10 Claims, 12 Drawing Sheets

(51) Int. Cl.

| | |
|---|---|
| ***F28D 3/02*** | (2006.01) |
| ***F28D 3/04*** | (2006.01) |
| ***F28D 7/16*** | (2006.01) |
| ***F28D 21/00*** | (2006.01) |
| ***F28F 9/22*** | (2006.01) |

(52) U.S. Cl.

CPC ..... *F28D 7/16* (2013.01); *F28D 21/0017* (2013.01); *F28F 9/22* (2013.01); *F25B 2339/0242* (2013.01); *F25B 2400/13* (2013.01); *F28D 2021/0071* (2013.01); *F28F 2280/02* (2013.01)

(56) References Cited

U.S. PATENT DOCUMENTS

| | | | |
|---|---|---|---|
| 2,059,725 | A | 11/1936 | Carrier |
| 2,091,757 | A | 8/1937 | Nanny |
| 2,274,391 | A | 2/1942 | Zwicki |
| 2,323,511 | A | 7/1943 | Baker |
| 2,384,413 | A | 9/1945 | Zwicki |
| 2,411,097 | A | 11/1946 | Kopp |
| 2,492,725 | A | 12/1949 | Ashley |
| 3,004,396 | A | 10/1961 | Endress et al. |
| 3,095,255 | A | 6/1963 | Smith |
| 3,132,064 | A | 5/1964 | Scheffers |
| 3,180,408 | A | 4/1965 | Grotz, Jr. et al. |
| 3,191,396 | A | 6/1965 | Ruddock |
| 3,197,387 | A | 7/1965 | Lawrance |
| 3,213,935 | A | 10/1965 | Reid, Jr. |
| 3,240,265 | A | 3/1966 | Weller |
| 3,259,181 | A | 7/1966 | Ashley et al. |
| 3,267,693 | A | 8/1966 | Richardson et al. |
| 3,276,217 | A | 10/1966 | Bourne et al. |
| 3,326,280 | A | 6/1967 | Bosquain et al. |
| 3,351,119 | A | 11/1967 | Rosenblad |
| 3,412,569 | A | 11/1968 | Arledge, Jr. |
| 3,412,778 | A | 11/1968 | Witt et al. |
| 3,635,040 | A | 1/1972 | Morris, Jr. |
| 3,735,811 | A | 5/1973 | Moser et al. |
| 3,775,993 | A | 12/1973 | Murphy |
| 3,831,390 | A | 8/1974 | Hopkins |
| 3,849,232 | A | 11/1974 | Kessler et al. |
| 4,154,642 | A | 5/1979 | Mattern et al. |
| 4,158,295 | A | 6/1979 | Sibley |
| 4,437,322 | A | 3/1984 | Ertinger |
| 4,511,432 | A | 4/1985 | Sephton |
| 4,520,866 | A | 6/1985 | Nakajima et al. |
| 4,706,741 | A | 11/1987 | Bolmstedt et al. |
| 4,918,944 | A | 4/1990 | Takahashi et al. |
| 4,944,839 | A | 7/1990 | Rosenblad |
| 4,972,903 | A | 11/1990 | Kwok |
| 4,977,861 | A | 12/1990 | Charbonnel et al. |
| 5,044,427 | A | 9/1991 | Love et al. |
| 5,059,226 | A | 10/1991 | Schneider et al. |
| 5,086,621 | A | 2/1992 | Starner et al. |
| 5,246,541 | A | 9/1993 | Ryham |
| 5,419,155 | A | 5/1995 | Boehde et al. |
| 5,461,883 | A | 10/1995 | Terasaki |
| 5,481,887 | A | 1/1996 | Terasaki |
| 5,561,987 | A | 10/1996 | Hartfield et al. |
| 5,575,889 | A | 11/1996 | Rosenblad |
| 5,588,596 | A | 12/1996 | Hartfield et al. |
| 5,638,691 | A | 6/1997 | Hartfield et al. |
| 5,645,124 | A | 7/1997 | Hartfield et al. |
| 5,791,404 | A | 8/1998 | Bailey et al. |
| 5,809,794 | A | 9/1998 | Sibik et al. |
| 5,836,382 | A | 11/1998 | Dingle et al. |
| 5,839,294 | A | 11/1998 | Chiang et al. |
| 5,849,148 | A | 12/1998 | Walker |
| 5,922,903 | A | 7/1999 | Pujado |
| 5,931,020 | A | 8/1999 | Nakamura |
| 6,035,651 | A | 3/2000 | Carey |
| 6,089,312 | A | 7/2000 | Biar et al. |
| 6,127,571 | A | 10/2000 | Mulvaney, III |
| 6,167,713 | B1 | 1/2001 | Hartfield et al. |
| 6,170,286 | B1 | 1/2001 | Keuper |
| 6,233,967 | B1 | 5/2001 | Seewald et al. |
| 6,253,571 | B1 | 7/2001 | Fujii et al. |
| 6,293,112 | B1 | 9/2001 | Moeykens et al. |
| 6,341,492 | B1 | 1/2002 | Carey |
| 6,357,239 | B2 | 3/2002 | Carey |
| 6,357,254 | B1 | 3/2002 | Xia |
| 6,516,627 | B2 | 2/2003 | Ring et al. |
| 6,532,763 | B1 | 3/2003 | Gupte |
| 6,596,244 | B1 | 7/2003 | Pujado |
| 6,606,882 | B1 | 8/2003 | Gupte |
| 6,695,043 | B1 | 2/2004 | Wagner et al. |
| 6,742,347 | B1 | 6/2004 | Kolk et al. |
| 6,748,763 | B2 | 6/2004 | Schweigert et al. |
| 6,749,817 | B1 | 6/2004 | Mulvaney, III |
| 6,830,099 | B2 | 12/2004 | Moeykens |
| 6,830,654 | B1 | 12/2004 | Salmisuo |
| 6,868,695 | B1 | 3/2005 | Dingel et al. |
| 2002/0007639 | A1 | 1/2002 | Carey |
| 2002/0137874 | A1 | 9/2002 | Hucks et al. |
| 2002/0162352 | A1 | 11/2002 | Ring et al. |
| 2003/0230105 | A1 | 12/2003 | Lee |
| 2004/0112573 | A1 | 6/2004 | Moeykens |
| 2004/0245084 | A1 | 12/2004 | Bethge |
| 2006/0080998 | A1 | 4/2006 | de Larminat et al. |
| 2008/0148767 | A1 | 6/2008 | de Larminat et al. |
| 2009/0178790 | A1* | 7/2009 | Schreiber ..... F25B 39/028 165/158 |
| 2011/0056664 | A1* | 3/2011 | De Larminat ..... F25B 39/028 165/160 |
| 2013/0269916 | A1* | 10/2013 | Schreiber ..... F28F 9/005 165/160 |
| 2013/0277018 | A1* | 10/2013 | Numata ..... F28D 3/02 165/157 |
| 2013/0277019 | A1* | 10/2013 | Numata ..... F25B 39/02 165/157 |
| 2015/0013950 | A1* | 1/2015 | Numata ..... F28F 9/007 165/157 |

FOREIGN PATENT DOCUMENTS

| | | | |
|---|---|---|---|
| GB | 769459 | A | 3/1957 |
| GB | 1033187 | A | 6/1966 |
| GB | 2161256 | A | 1/1986 |
| JP | 5752768 | A | 3/1982 |
| WO | 9905463 | A1 | 2/1999 |
| WO | 2006044448 | A2 | 4/2006 |
| WO | 2009111025 | A2 | 9/2009 |

* cited by examiner

VAPOR COMPRESSION SYSTEM

CROSS-REFERENCE TO RELATED APPLICATIONS

This application claims priority from and the benefit of U.S. Provisional Application No. 61/020,533, entitled FALLING FILM EVAPORATOR SYSTEMS, filed Jan. 11, 2008, which is hereby incorporated by reference.

BACKGROUND

The application relates generally to vapor compression systems in refrigeration, air conditioning and chilled liquid systems.

Conventional chilled liquid systems used in heating, ventilation and air conditioning systems include an evaporator to effect a transfer of thermal energy between the refrigerant of the system and another liquid to be cooled. One type of evaporator includes a shell with a plurality of tubes forming a tube bundle, or a plurality of tube bundles, through which the liquid to be cooled is circulated. The refrigerant is brought into contact with the outer or exterior surfaces of the tube bundle inside the shell, resulting in a transfer of thermal energy between the liquid to be cooled and the refrigerant. For example, refrigerant can be deposited onto the exterior surfaces of the tube bundle by spraying or other similar techniques in what is commonly referred to as a "falling film" evaporator. In a further example, the exterior surfaces of the tube bundle can be fully or partially immersed in liquid refrigerant in what is commonly referred to as a "flooded" evaporator. In yet another example, a portion of the tube bundle can have refrigerant deposited on the exterior surfaces and another portion of the tube bundle can be immersed in liquid refrigerant in what is commonly referred to as a "hybrid falling film" evaporator.

As a result of the thermal energy transfer with the liquid, the refrigerant is heated and converted to a vapor state, which is then returned to a compressor where the vapor is compressed, to begin another refrigerant cycle. The cooled liquid can be circulated to a plurality of heat exchangers located throughout a building. Warmer air from the building is passed over the heat exchangers where the cooled liquid is warmed, while cooling the air for the building. The liquid warmed by the building air is returned to the evaporator to repeat the process.

SUMMARY

The present invention relates to a vapor compression system including a compressor, a condenser, an expansion device and an evaporator connected by a refrigerant line. The evaporator includes a shell, a first tube bundle; a hood; a distributor; a first supply line; a second supply line; a valve positioned in the second supply line; and a sensor. The first tube bundle includes a plurality of tubes extending substantially horizontally in the shell. The distributor is positioned above the first tube bundle. The hood covers the first tube bundle. The first supply line is connected to the distributor and an end of the second supply line is positioned near the hood. The sensor is configured and positioned to sense a level of liquid refrigerant in the shell. The valve is configured and positioned to regulate flow in the second supply line in response to a sensed level of liquid refrigerant from the level sensor.

The present invention also relates to a vapor compression system includes a compressor, a condenser, an expansion device and an evaporator connected by a refrigerant line. The evaporator includes a shell; a first tube bundle; a hood; a distributor; a supply line; a pump; an expansion device; a sensor; and wherein the first tube bundle comprises a plurality of tubes extending substantially horizontally in the shell. The distributor is positioned above the first tube bundle. The hood covers the first tube bundle The supply line is connected to the expansion device and the expansion device is connected to a discharge of the pump. The sensor is configured and positioned to sense a level of liquid refrigerant in the shell. The pump is operated in response to a sensed level of liquid refrigerant decreasing below a predetermined level when the expansion device is in an open position.

The present invention further relates to an evaporator including a shell; a tube bundle; an enclosure; and a supply line. The tube bundle includes a plurality of tubes extending substantially horizontally in the shell. The enclosure receives refrigerant from the supply line and provides liquid refrigerant for the tube bundle and vapor refrigerant for an outlet connection in the shell.

DETAILED DESCRIPTION OF THE EXEMPLARY EMBODIMENTS

Figure 1:
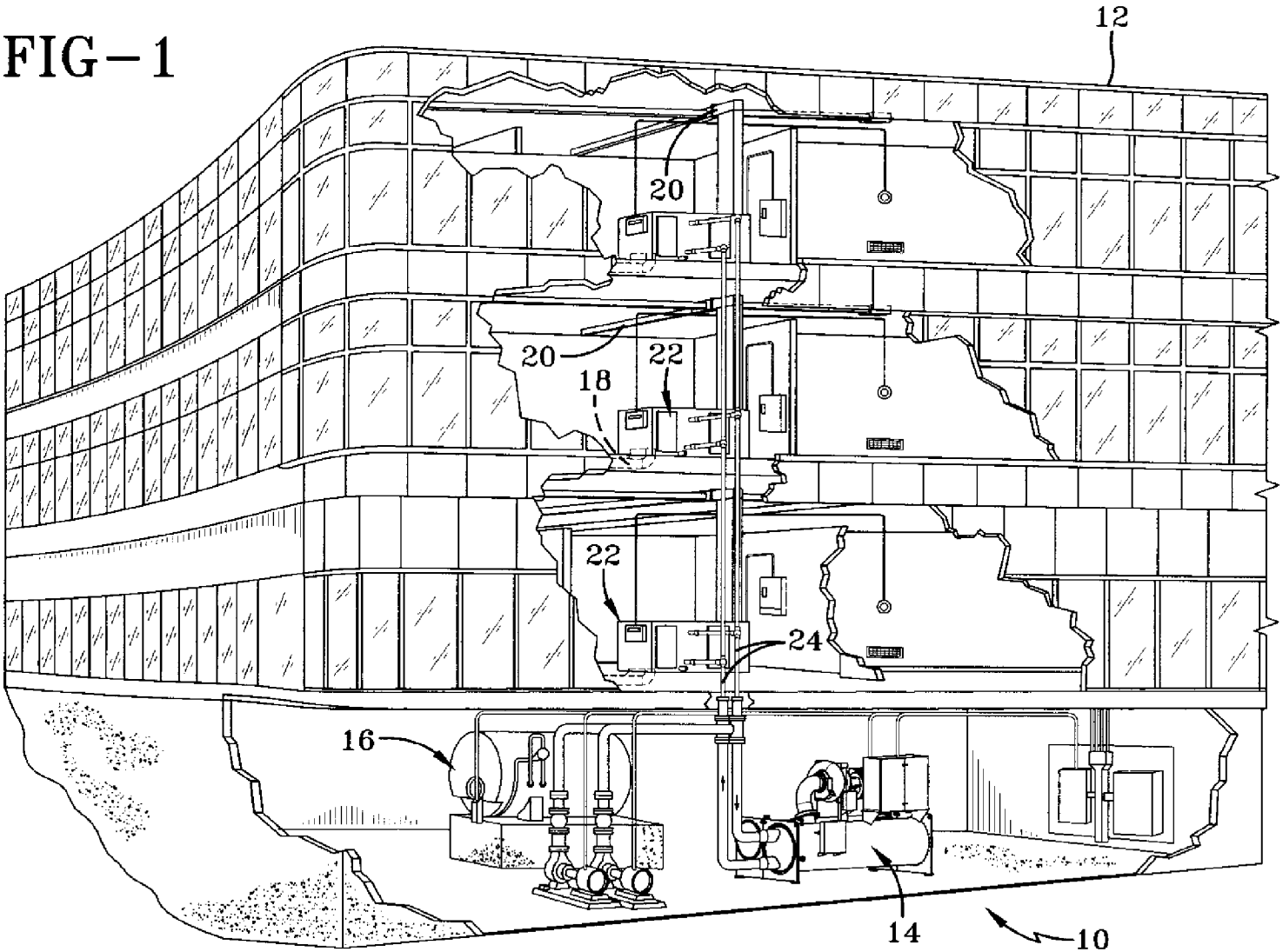
FIG. 1 shows an exemplary embodiment for a heating, ventilation and air conditioning system.

FIG. 1 shows an exemplary environment for a heating, ventilation and air conditioning (HVAC) system 10 incorporating a chilled liquid system in a building 12 for a typical commercial setting. System 10 can include a vapor compression system 14 that can supply a chilled liquid which may be used to cool building 12. System 10 can include a boiler 16 to supply heated liquid that may be used to heat building 12, and an air distribution system which circulates air through building 12. The air distribution system can also include an air return duct 18, an air supply duct 20 and an air handler 22. Air handler 22 can include a heat exchanger that is connected to boiler 16 and vapor compression system 14 by conduits 24. The heat exchanger in air handler 22 may receive either heated liquid from boiler 16 or chilled liquid from vapor compression system 14, depending on the mode of operation of system 10. System 10 is shown with a separate air handler on each floor of building 12, but it is appreciated that the components may be shared between or among floors.

Figure 2:
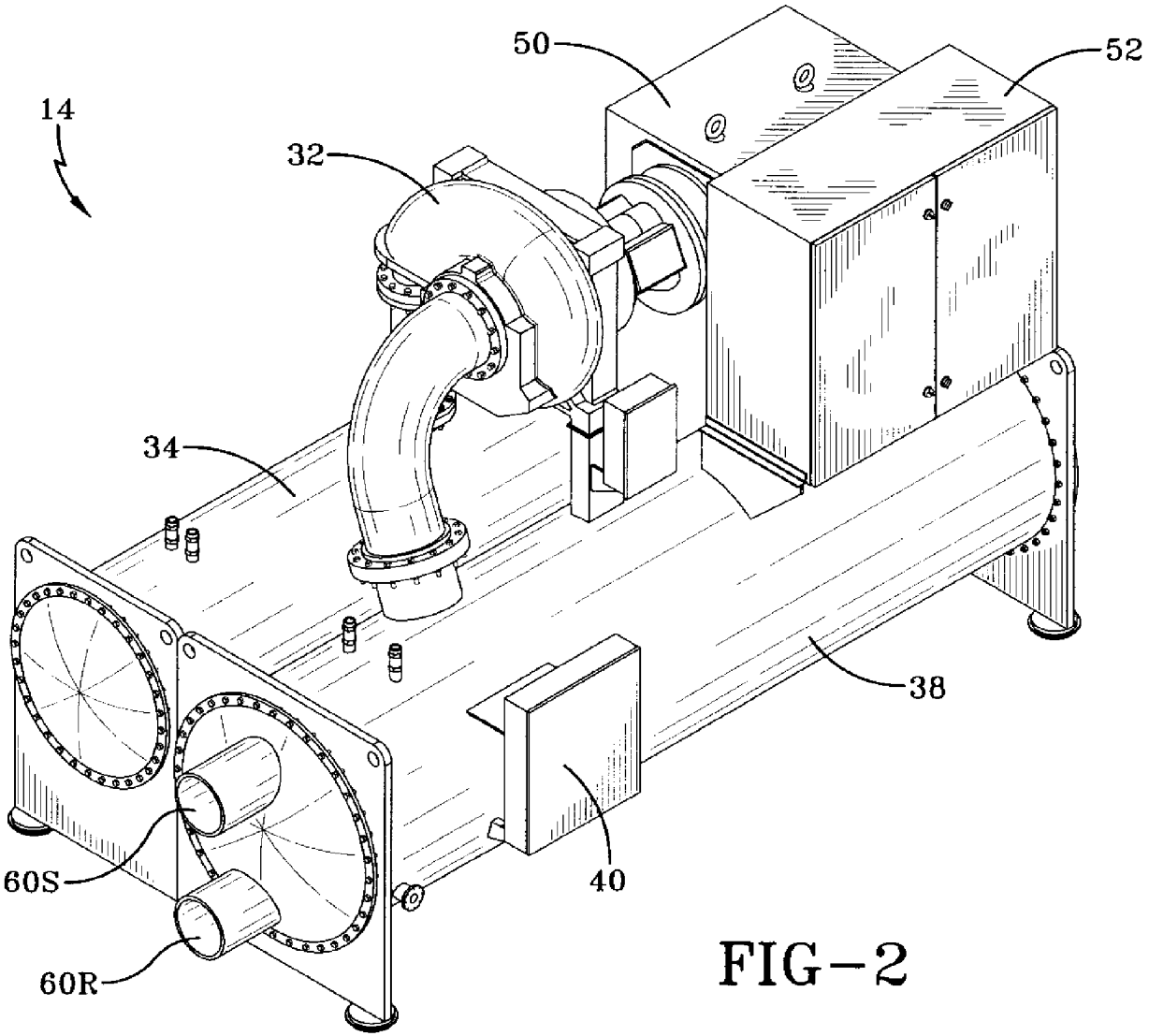
FIG. 2 shows an isometric view of an exemplary vapor compression system.
Figure 3:
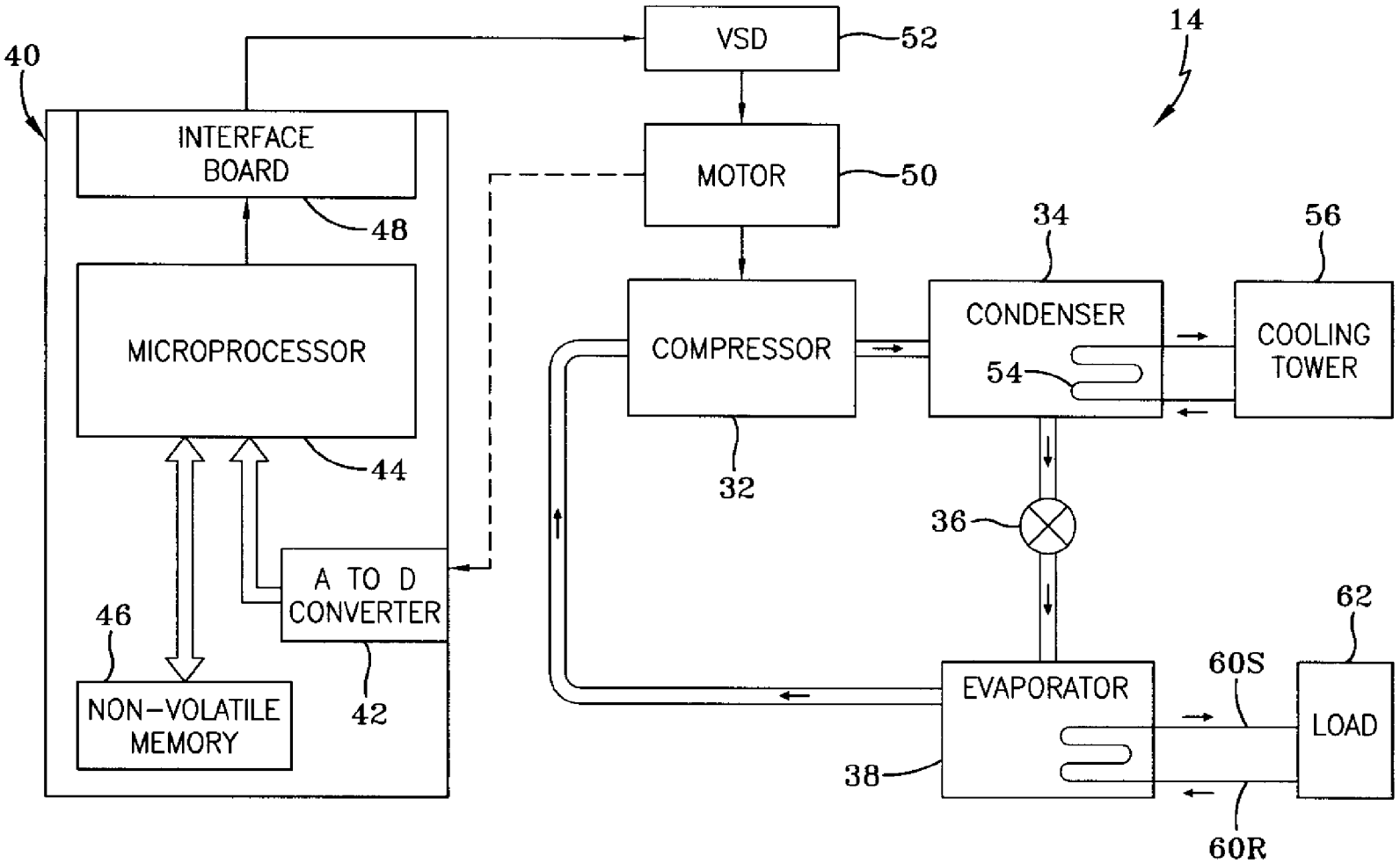
FIGS. 3 and 4 schematically illustrate exemplary embodiments of the vapor compression system.

FIGS. 2 and 3 show an exemplary vapor compression system 14 that can be used in an HVAC system, such as HVAC system 10. Vapor compression system 14 can circulate a refrigerant through a compressor 32 driven by a motor 50, a condenser 34, expansion device(s) 36, and a liquid chiller or evaporator 38. Vapor compression system 14 can also include a control panel 40 that can include an analog to digital (A/D) converter 42, a microprocessor 44, a non-volatile memory 46, and an interface board 48. Some examples of fluids that may be used as refrigerants in vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In an exemplary embodiment, vapor compression system 14 may use one or more of each of VSDs 52, motors 50, compressors 32, condensers 34 and/or evaporators 38.

Motor 50 used with compressor 32 can be powered by a variable speed drive (VSD) 52 or can be powered directly from an alternating current (AC) or direct current (DC) power source. VSD 52, if used, receives AC power having a particular fixed line voltage and fixed line frequency from the AC power source and provides power having a variable voltage and frequency to motor 50. Motor 50 can include any type of electric motor that can be powered by a VSD or directly from an AC or DC power source. For example, motor 50 can be a switched reluctance motor, an induction motor, an electronically commutated permanent magnet motor or any other suitable motor type. In an alternate exemplary embodiment, other drive mechanisms such as steam or gas turbines or engines and associated components can be used to drive compressor 32.

Compressor 32 compresses a refrigerant vapor and delivers the vapor to condenser 34 through a discharge line. Compressor 32 can be a centrifugal compressor, screw compressor, reciprocating compressor, rotary compressor, swing link compressor, scroll compressor, turbine compressor, or any other suitable compressor. The refrigerant vapor delivered by compressor 32 to condenser 34 transfers heat to a fluid, for example, water or air. The refrigerant vapor condenses to a refrigerant liquid in condenser 34 as a result of the heat transfer with the fluid. The liquid refrigerant from condenser 34 flows through expansion device 36 to evaporator 38. In the exemplary embodiment shown in FIG. 3, condenser 34 is water cooled and includes a tube bundle 54 connected to a cooling tower 56.

The liquid refrigerant delivered to evaporator 38 absorbs heat from another fluid, which may or may not be the same type of fluid used for condenser 34, and undergoes a phase change to a refrigerant vapor. In the exemplary embodiment shown in FIG. 3, evaporator 38 includes a tube bundle having a supply line 60S and a return line 60R connected to a cooling load 62. A process fluid, for example, water, ethylene glycol, calcium chloride brine, sodium chloride brine, or any other suitable liquid, enters evaporator 38 via return line 60R and exits evaporator 38 via supply line 60S. Evaporator 38 chills the temperature of the process fluid in the tubes. The tube bundle in evaporator 38 can include a plurality of tubes and a plurality of tube bundles. The vapor refrigerant exits evaporator 38 and returns to compressor 32 by a suction line to complete the cycle.

Figure 4:
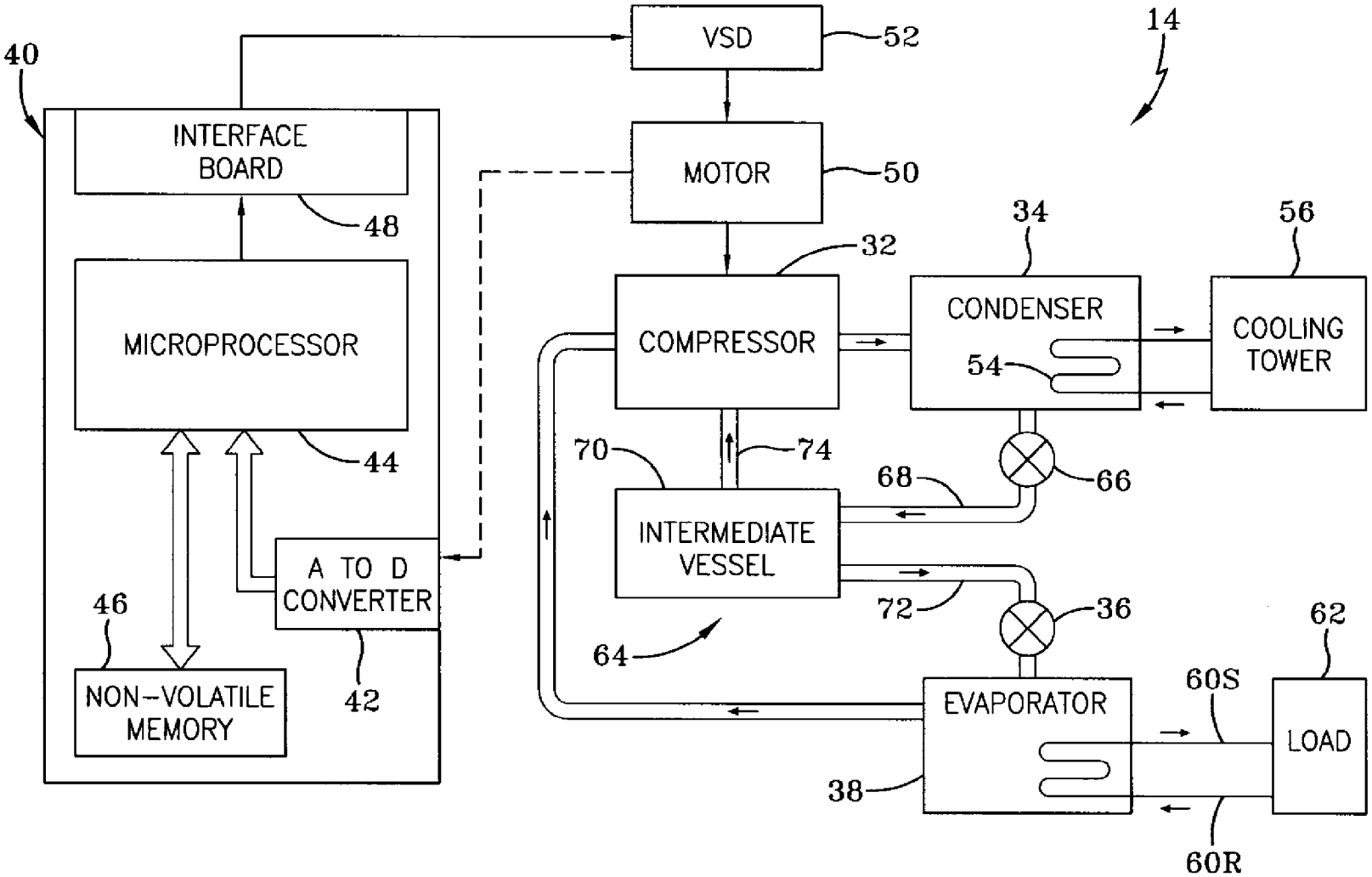

FIG. 4, which is similar to FIG. 3, shows the refrigerant circuit with an intermediate circuit 64 that may be incorporated between condenser 34 and expansion device 36 to provide increased cooling capacity, efficiency and performance. Intermediate circuit 64 has an inlet line 68 that can be either connected directly to or can be in fluid communication with condenser 34. As shown, inlet line 68 includes an expansion device 66 positioned upstream of an intermediate vessel 70. Intermediate vessel 70 can be a flash tank, also referred to as a flash intercooler, in an exemplary embodiment. In an alternate exemplary embodiment, intermediate vessel 70 can be configured as a heat exchanger or a "surface economizer". In the flash intercooler arrangement, a first expansion device 66 operates to lower the pressure of the liquid received from condenser 34. During the expansion process in a flash intercooler, a portion of the liquid is evaporated. Intermediate vessel 70 may be used to separate the evaporated vapor from the liquid received from the condenser. The evaporated liquid may be drawn by compressor 32 to a port at a pressure intermediate between suction and discharge or at an intermediate stage of compression, through a line 74. The liquid that is not evaporated is cooled by the expansion process, and collects at the bottom of intermediate vessel 70, where the liquid is recovered to flow to the evaporator 38, through a line 72 comprising a second expansion device 36.

In the "surface intercooler" arrangement, the implementation is slightly different, as known to those skilled in the art. Intermediate circuit 64 can operate in a similar matter to that described above, except that instead of receiving the entire amount of refrigerant from condenser 34, as shown in FIG. 4, intermediate circuit 64 receives only a portion of the refrigerant from condenser 34 and the remaining refrigerant proceeds directly to expansion device 36.

Figure 5A:
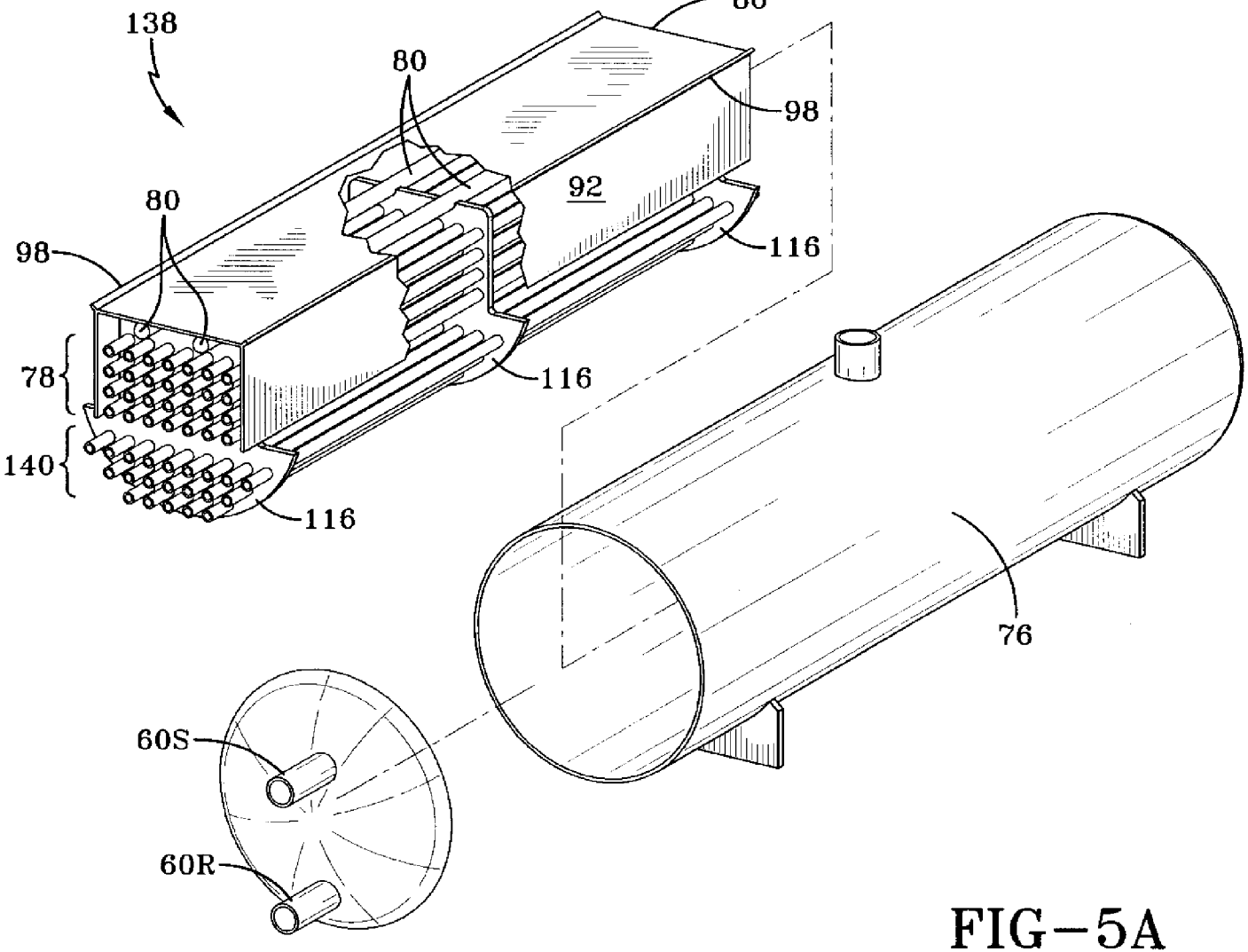
FIG. 5A shows an exploded, partial cutaway view of an exemplary evaporator.
Figure 5B:
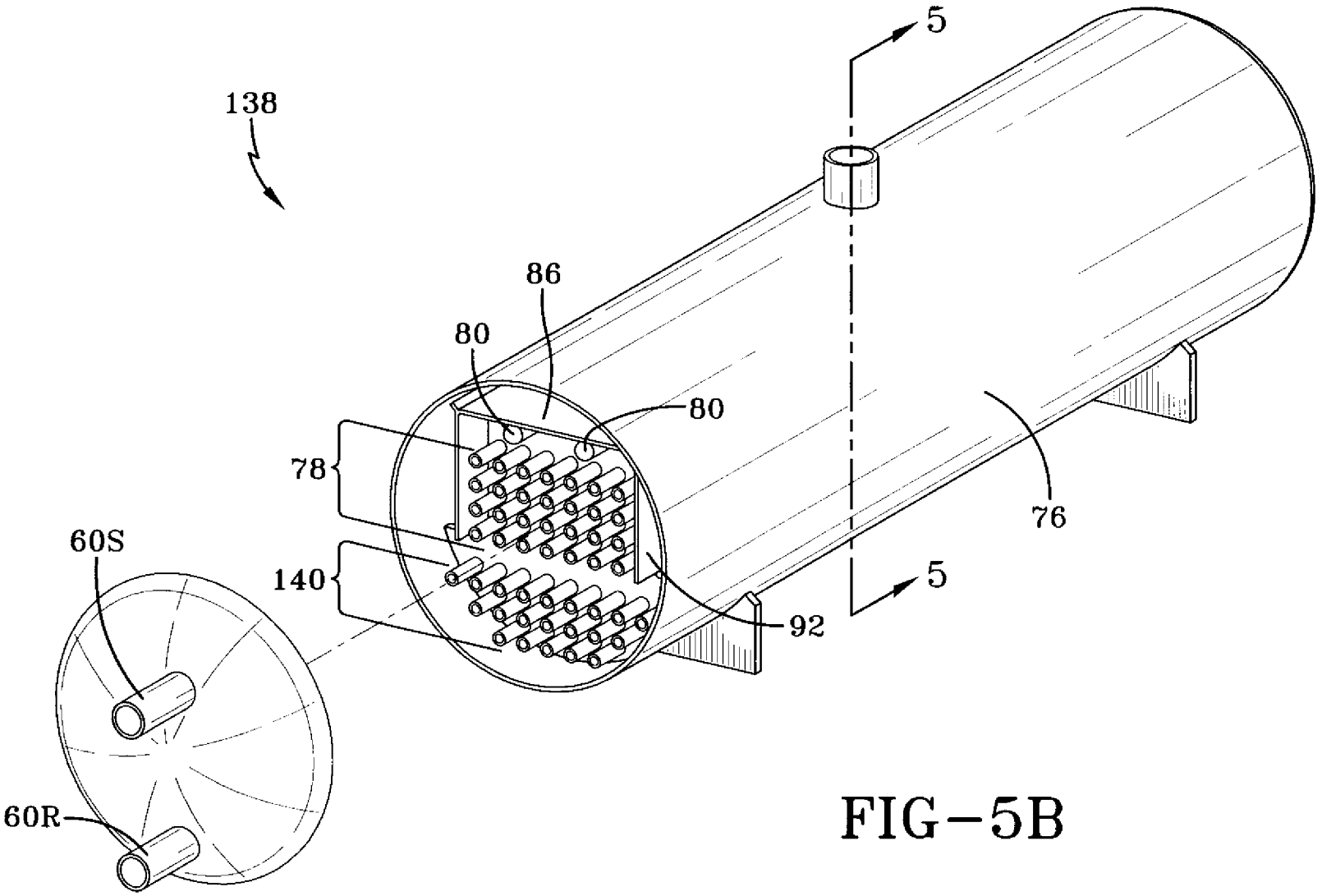
FIG. 5B shows a top isometric view of the evaporator of FIG. 5A.
Figure 5C:
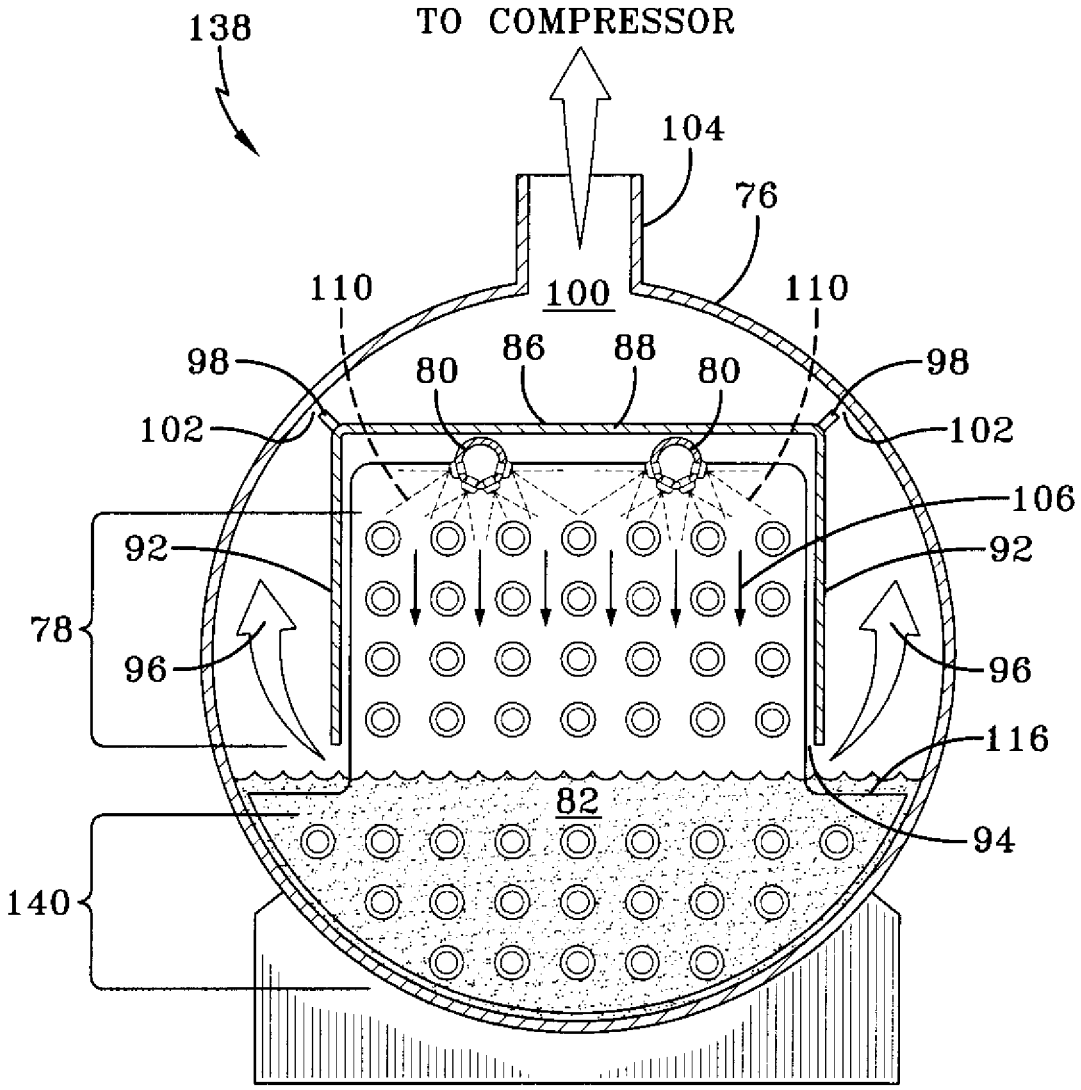
FIG. 5C shows a cross section of the evaporator taken along line 5-5 of FIG. 5B.

FIGS. 5A through 5C show an exemplary embodiment of an evaporator configured as a "hybrid falling film" evaporator. As shown in FIGS. 5A through 5C, an evaporator 138 includes a substantially cylindrical shell 76 with a plurality of tubes forming a tube bundle 78 extending substantially horizontally along the length of shell 76. At least one support 116 may be positioned inside shell 76 to support the plurality of tubes in tube bundle 78. A suitable fluid, such as water, ethylene, ethylene glycol, or calcium chloride brine flows through the tubes of tube bundle 78. A distributor 80 positioned above tube bundle 78 distributes, deposits or applies refrigerant 110 from a plurality of positions onto the tubes in tube bundle 78. In one exemplary embodiment, the refrigerant deposited by distributor 80 can be entirely liquid refrigerant, although in another exemplary embodiment, the refrigerant deposited by distributor 80 can include both liquid refrigerant and vapor refrigerant.

Liquid refrigerant that flows around the tubes of tube bundle 78 without changing state collects in the lower portion of shell 76. The collected liquid refrigerant can form a pool or reservoir of liquid refrigerant 82. The deposition positions from distributor 80 can include any combination of longitudinal or lateral positions with respect to tube bundle 78. In another exemplary embodiment, deposition positions from distributor 80 are not limited to ones that deposit onto the upper tubes of tube bundle 78. Distributor 80 may include a plurality of nozzles supplied by a dispersion source of the refrigerant. In an exemplary embodiment, the dispersion source is a tube connecting a source of refrigerant, such as condenser 34. Nozzles include spraying nozzles, but also include machined openings that can guide or direct refrigerant onto the surfaces of the tubes. The nozzles may apply refrigerant in a predetermined pattern, such as a jet pattern, so that the upper row of tubes of tube bundle 78 are covered. The tubes of tube bundle 78 can be arranged to promote the flow of refrigerant in the form of a film around the tube surfaces, the liquid refrigerant coalescing to form droplets or in some instances, a curtain or sheet of liquid refrigerant at the bottom of the tube surfaces. The resulting sheeting promotes wetting of the tube surfaces which enhances the heat transfer efficiency between the fluid flowing inside the tubes of tube bundle 78 and the refrigerant flowing around the surfaces of the tubes of tube bundle 78.

In the pool of liquid refrigerant 82, a tube bundle 140 can be immersed or at least partially immersed, to provide additional thermal energy transfer between the refrigerant and the process fluid to evaporate the pool of liquid refrigerant 82. In an exemplary embodiment, tube bundle 78 can be positioned at least partially above (that is, at least partially overlying) tube bundle 140. In one exemplary embodiment, evaporator 138 incorporates a two pass system, in which the process fluid that is to be cooled first flows inside the tubes of tube bundle 140 and then is directed to flow inside the tubes of tube bundle 78 in the opposite direction to the flow in tube bundle 140. In the second pass of the two pass system, the temperature of the fluid flowing in tube bundle 78 is reduced, thus requiring a lesser amount of heat transfer with the refrigerant flowing over the surfaces of tube bundle 78 to obtain a desired temperature of the process fluid.

It is to be understood that although a two pass system is described in which the first pass is associated with tube bundle 140 and the second pass is associated with tube bundle 78, other arrangements are contemplated. For example, evaporator 138 can incorporate a one pass system where the process fluid flows through both tube bundle 140 and tube bundle 78 in the same direction. Alternatively, evaporator 138 can incorporate a three pass system in which two passes are associated with tube bundle 140 and the remaining pass associated with tube bundle 78, or in which one pass is associated with tube bundle 140 and the remaining two passes are associated with tube bundle 78. Further, evaporator 138 can incorporate an alternate two pass system in which one pass is associated with both tube bundle 78 and tube bundle 140, and the second pass is associated with both tube bundle 78 and tube bundle 140. In one exemplary embodiment, tube bundle 78 is positioned at least partially above tube bundle 140, with a gap separating tube bundle 78 from tube bundle 140. In a further exemplary embodiment, hood 86 overlies tube bundle 78, with hood 86 extending toward and terminating near the gap. In summary, any number of passes in which each pass can be associated with one or both of tube bundle 78 and tube bundle 140 is contemplated.

An enclosure or hood 86 is positioned over tube bundle 78 to substantially prevent cross flow, that is, a lateral flow of vapor refrigerant or liquid and vapor refrigerant 106 between the tubes of tube bundle 78. Hood 86 is positioned over and laterally borders tubes of tube bundle 78. Hood 86 includes an upper end 88 positioned near the upper portion of shell 76. Distributor 80 can be positioned between hood 86 and tube bundle 78. In yet a further exemplary embodiment, distributor 80 may be positioned near, but exterior of, hood 86, so that distributor 80 is not positioned between hood 86 and tube bundle 78. However, even though distributor 80 is not positioned between hood 86 and tube bundle 78, the nozzles of distributor 80 are still configured to direct or apply refrigerant onto surfaces of the tubes. Upper end 88 of hood 86 is configured to substantially prevent the flow of applied refrigerant 110 and partially evaporated refrigerant, that is, liquid and/or vapor refrigerant 106 from flowing directly to outlet 104. Instead, applied refrigerant 110 and refrigerant 106 are constrained by hood 86, and, more specifically, are forced to travel downward between walls 92 before the refrigerant can exit through an open end 94 in the hood 86. Flow of vapor refrigerant 96 around hood 86 also includes evaporated refrigerant flowing away from the pool of liquid refrigerant 82.

It is to be understood that at least the above-identified, relative terms are non-limiting as to other exemplary embodiments in the disclosure. For example, hood 86 may be rotated with respect to the other evaporator components previously discussed, that is, hood 86, including walls 92, is not limited to a vertical orientation. Upon sufficient rotation of hood 86 about an axis substantially parallel to the tubes of tube bundle 78, hood 86 may no longer be considered "positioned over" nor to "laterally border" tubes of tube bundle 78. Similarly, "upper" end 88 of hood 86 may no longer be near "an upper portion" of shell 76, and other exemplary embodiments are not limited to such an arrangement between the hood and the shell. In an exemplary embodiment, hood 86 terminates after covering tube bundle 78, although in another exemplary embodiment, hood 86 further extends after covering tube bundle 78.

After hood 86 forces refrigerant 106 downward between walls 92 and through open end 94, the vapor refrigerant undergoes an abrupt change in direction before traveling in the space between shell 76 and walls 92 from the lower portion of shell 76 to the upper portion of shell 76. Combined with the effect of gravity, the abrupt directional change in flow results in a proportion of any entrained droplets of refrigerant colliding with either liquid refrigerant 82 or shell 76, thereby removing those droplets from the flow of vapor refrigerant 96. Also, refrigerant mist traveling along the length of hood 86 between walls 92 is coalesced into larger drops that are more easily separated by gravity, or maintained sufficiently near or in contact with tube bundle 78, to permit evaporation of the refrigerant mist by heat transfer with the tube bundle. As a result of the increased drop size, the efficiency of liquid separation by gravity is improved, permitting an increased upward velocity of vapor refrigerant 96 flowing through the evaporator in the space between walls 92 and shell 76. Vapor refrigerant 96, whether flowing from open end 94 or from the pool of liquid refrigerant 82, flows over a pair of extensions 98 protruding from walls 92 near upper end 88 and into a channel 100. Vapor refrigerant 96 enters into channel 100 through slots 102, which is the space between the ends of extensions 98 and shell 76, before exiting evaporator 138 at an outlet 104. In another exemplary embodiment, vapor refrigerant 96 can enter into channel 100 through openings or apertures formed in extensions 98, instead of slots 102. In yet another exemplary embodiment, slots 102 can be formed by the space between hood 86 and shell 76, that is, hood 86 does not include extensions 98.

Stated another way, once refrigerant 106 exits from hood 86, vapor refrigerant 96 then flows from the lower portion of shell 76 to the upper portion of shell 76 along the prescribed passageway. In an exemplary embodiment, the passageways can be substantially symmetric between the surfaces of hood 86 and shell 76 prior to reaching outlet 104. In an exemplary embodiment, baffles, such as extensions 98 are provided near the evaporator outlet to prevent a direct path of vapor refrigerant 96 to the compressor inlet.

In one exemplary embodiment, hood 86 includes opposed substantially parallel walls 92. In another exemplary embodiment, walls 92 can extend substantially vertically and terminate at open end 94, that is located substantially opposite upper end 88. Upper end 88 and walls 92 are closely positioned near the tubes of tube bundle 78, with walls 92 extending toward the lower portion of shell 76 so as to substantially laterally border the tubes of tube bundle 78. In an exemplary embodiment, walls 92 may be spaced between about 0.02 inch (0.5 mm) and about 0.8 inch (20 mm) from the tubes in tube bundle 78. In a further exemplary embodiment, walls 92 may be spaced between about 0.1 inch (3 mm) and about 0.2 inch (5 mm) from the tubes in tube bundle 78. However, spacing between upper end 88 and the tubes of tube bundle 78 may be significantly greater than 0.2 inch (5 mm), in order to provide sufficient spacing to position distributor 80 between the tubes and the upper end of the hood. In an exemplary embodiment in which walls 92 of hood 86 are substantially parallel and shell 76 is cylindrical, walls 92 may also be symmetric about a central vertical plane of symmetry of the shell bisecting the space separating walls 92. In other exemplary embodiments, walls 92 need not extend vertically past the lower tubes of tube bundle 78, nor do walls 92 need to be planar, as walls 92 may be curved or have other non-planar shapes. Regardless of the specific construction, hood 86 is configured to channel refrigerant 106 within the confines of walls 92 through open end 94 of hood 86.

Figure 6A:
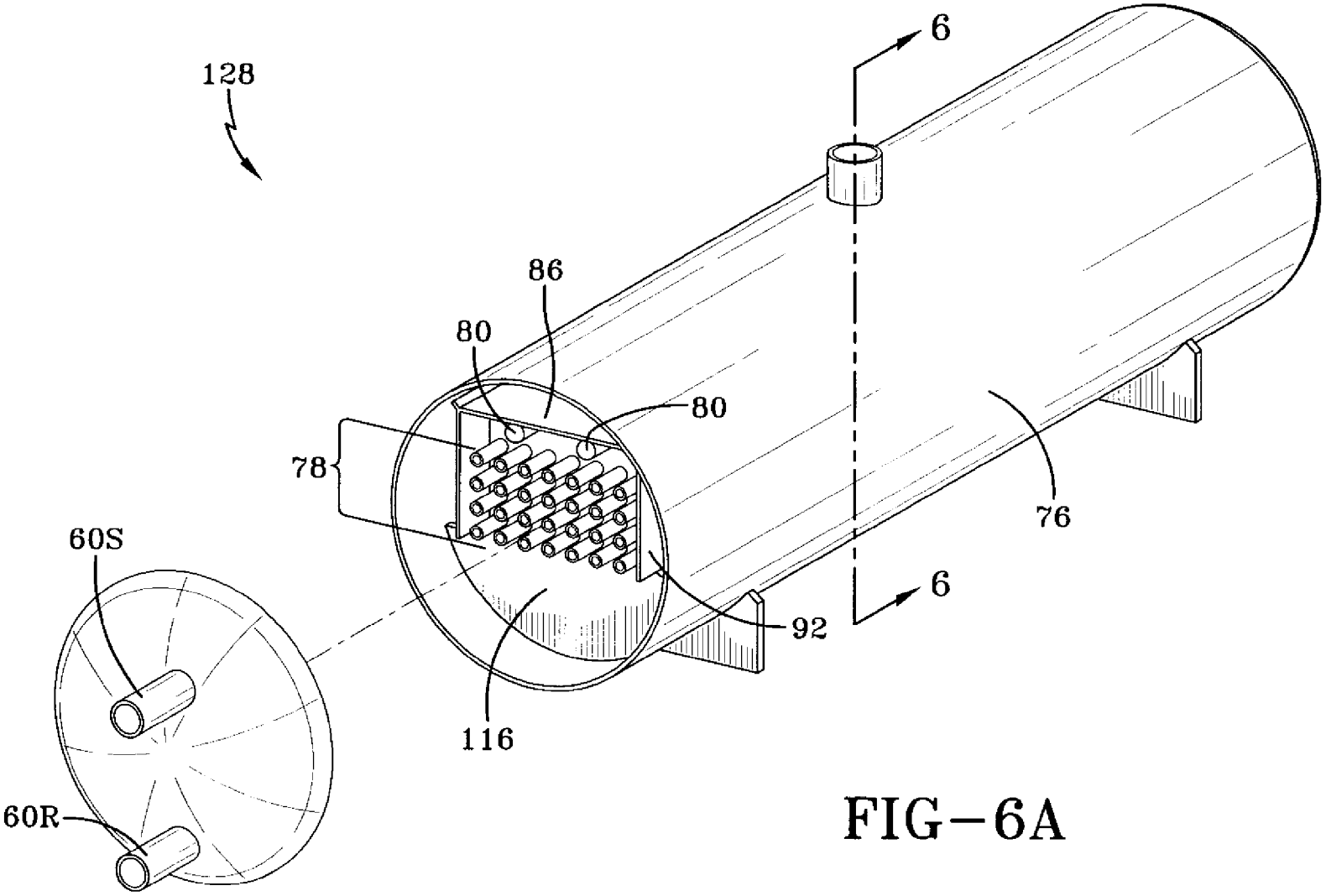
FIG. 6A shows a top isometric view of an exemplary evaporator.
Figure 6B:
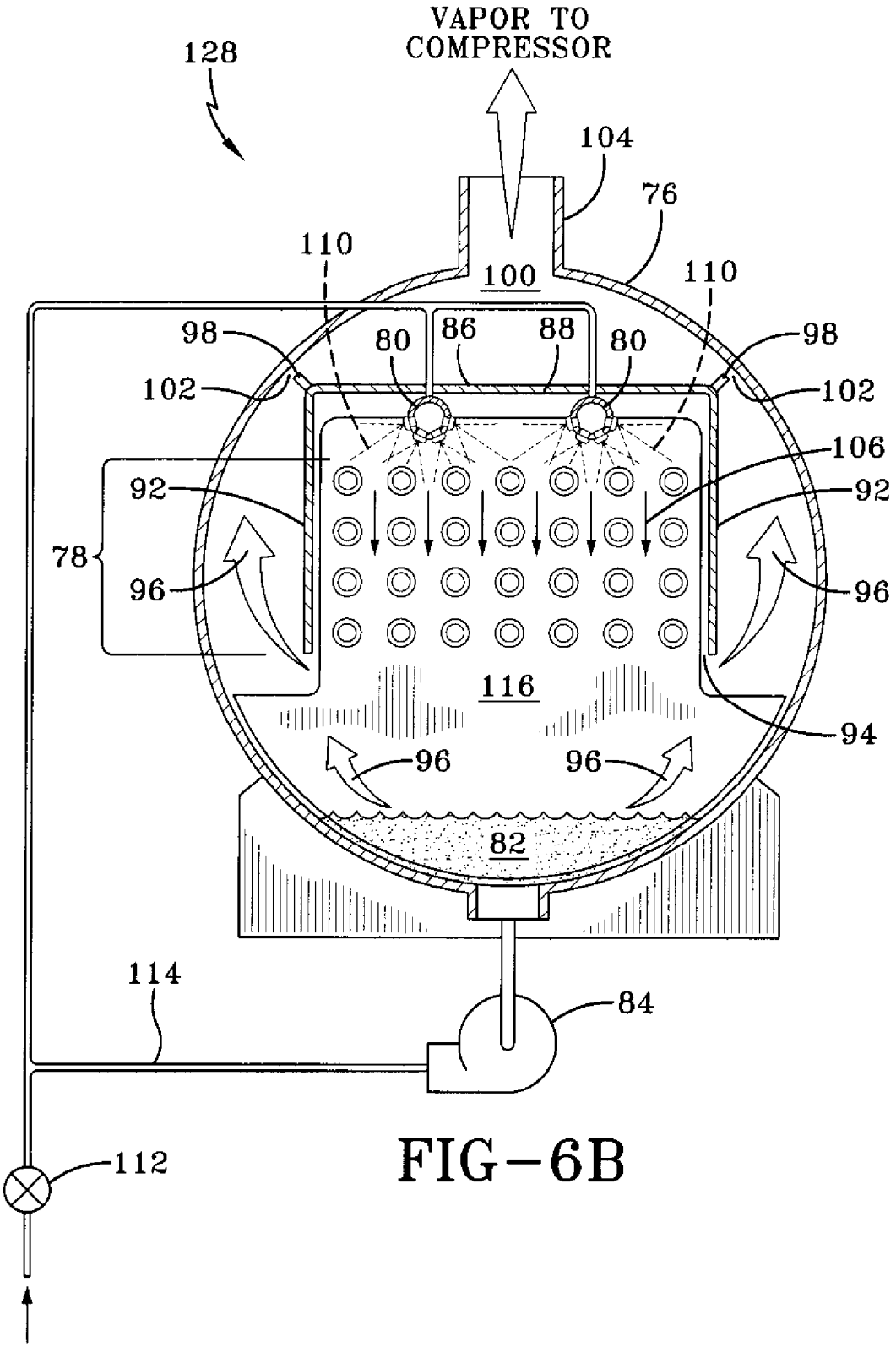
FIGS. 6B and 6C show a cross section of the evaporator taken along line 6-6 of FIG. 6A.
Figure 6C:
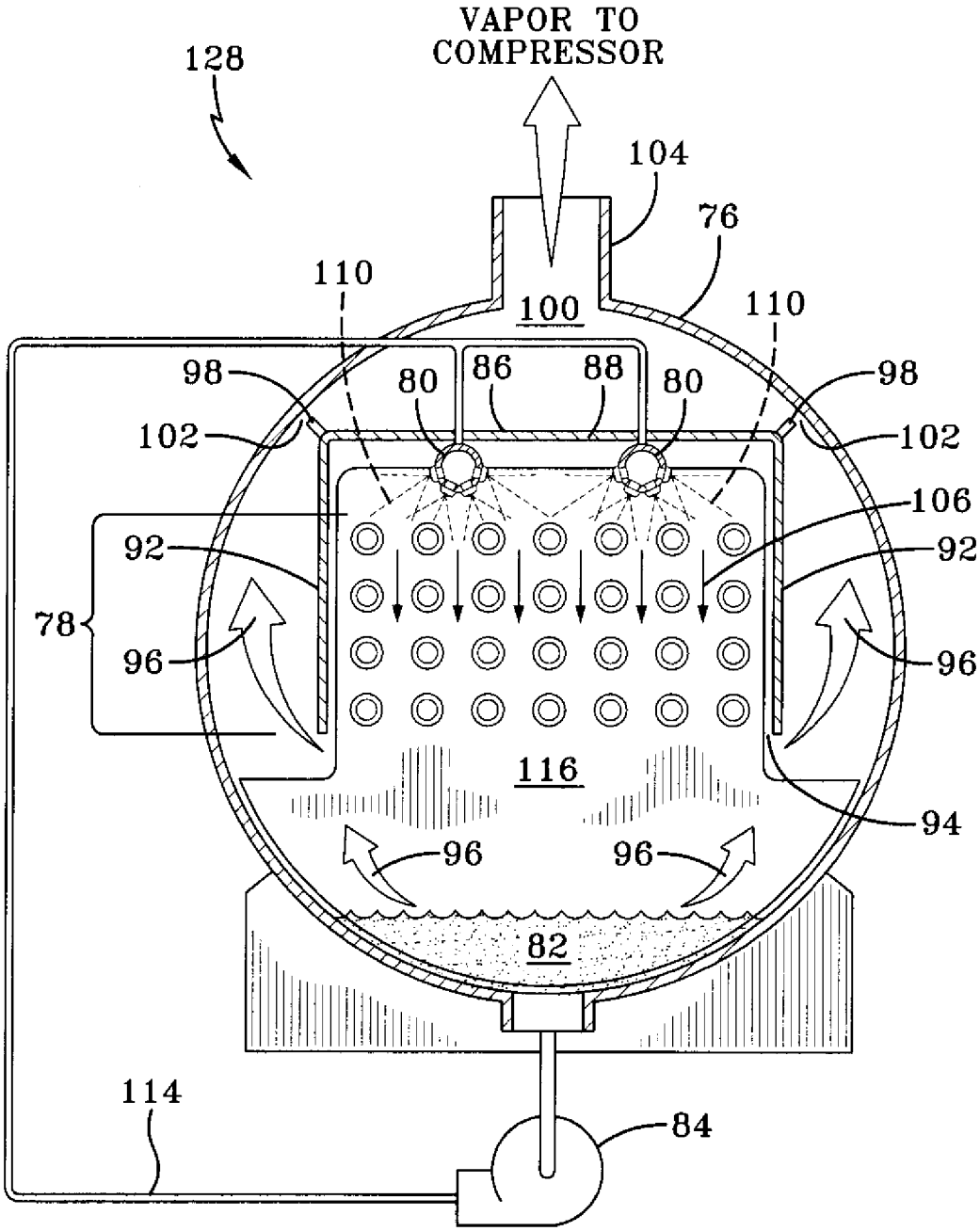

FIGS. 6A through 6C show an exemplary embodiment of an evaporator configured as a "falling film" evaporator 128. As shown in FIGS. 6A through 6C, evaporator 128 is similar to evaporator 138 shown in FIGS. 5A through 5C, except that evaporator 128 does not include tube bundle 140 in the pool of refrigerant 82 that collects in the lower portion of the shell. In an exemplary embodiment, hood 86 terminates after covering tube bundle 78, although in another exemplary embodiment, hood 86 further extends toward pool of refrigerant 82 after covering tube bundle 78. In yet a further exemplary embodiment, hood 86 terminates so that the hood does not totally cover the tube bundle, that is, substantially covers the tube bundle.

As shown in FIGS. 6B and 6C, a pump 84 can be used to recirculate the pool of liquid refrigerant 82 from the lower portion of the shell 76 via line 114 to distributor 80. As further shown in FIG. 6B, line 114 can include a regulating device 112 that can be in fluid communication with a condenser (not shown). In another exemplary embodiment, an ejector (not shown) can be employed to draw liquid refrigerant 82 from the lower portion of shell 76 using the pressurized refrigerant from condenser 34, which operates by virtue of the Bernoulli effect. The ejector combines the functions of a regulating device 112 and a pump 84.

In an exemplary embodiment, one arrangement of tubes or tube bundles may be defined by a plurality of uniformly spaced tubes that are aligned vertically and horizontally, forming an outline that can be substantially rectangular. However, a stacking arrangement of tube bundles can be used where the tubes are neither vertically or horizontally aligned, as well as arrangements that are not uniformly spaced.

In another exemplary embodiment, different tube bundle constructions are contemplated. For example, finned tubes (not shown) can be used in a tube bundle, such as along the uppermost horizontal row or uppermost portion of the tube bundle. Besides the possibility of using finned tubes, tubes developed for more efficient operation for pool boiling applications, such as in "flooded" evaporators, may also be employed. Additionally, or in combination with the finned tubes, porous coatings can also be applied to the outer surface of the tubes of the tube bundles.

In a further exemplary embodiment, the cross-sectional profile of the evaporator shell may be non-circular.

In an exemplary embodiment, a portion of the hood may partially extend into the shell outlet.

In addition, it is possible to incorporate the expansion functionality of the expansion devices of system 14 into distributor 80. In one exemplary embodiment, two expansion devices may be employed. One expansion device is exhibited in the spraying nozzles of distributor 80. The other expansion device, for example, expansion device 36, can provide a preliminary partial expansion of refrigerant, before that provided by the spraying nozzles positioned inside the evaporator. In an exemplary embodiment, the other expansion device, that is, the non-spraying nozzle expansion device, can be controlled by the level of liquid refrigerant 82 in the evaporator to account for variations in operating conditions, such as evaporating and condensing pressures, as well as partial cooling loads. In an alternative exemplary embodiment, expansion device can be controlled by the level of liquid refrigerant in the condenser, or in a further exemplary embodiment, a "flash economizer" vessel. In one exemplary embodiment, the majority of the expansion can occur in the nozzles, providing a greater pressure difference, while simultaneously permitting the nozzles to be of reduced size, therefore reducing the size and cost of the nozzles.

Figure 7A:
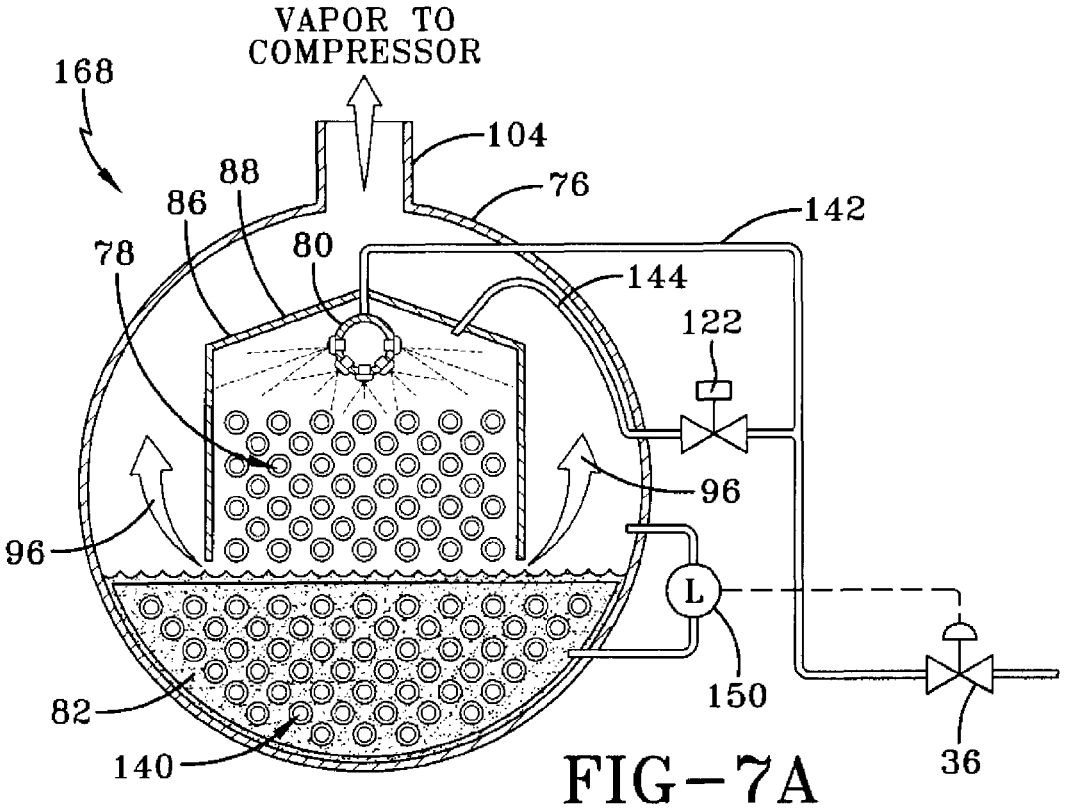
FIG. 7A shows a cross section of another exemplary evaporator having an additional refrigerant distribution supply line.
Figure 7B:
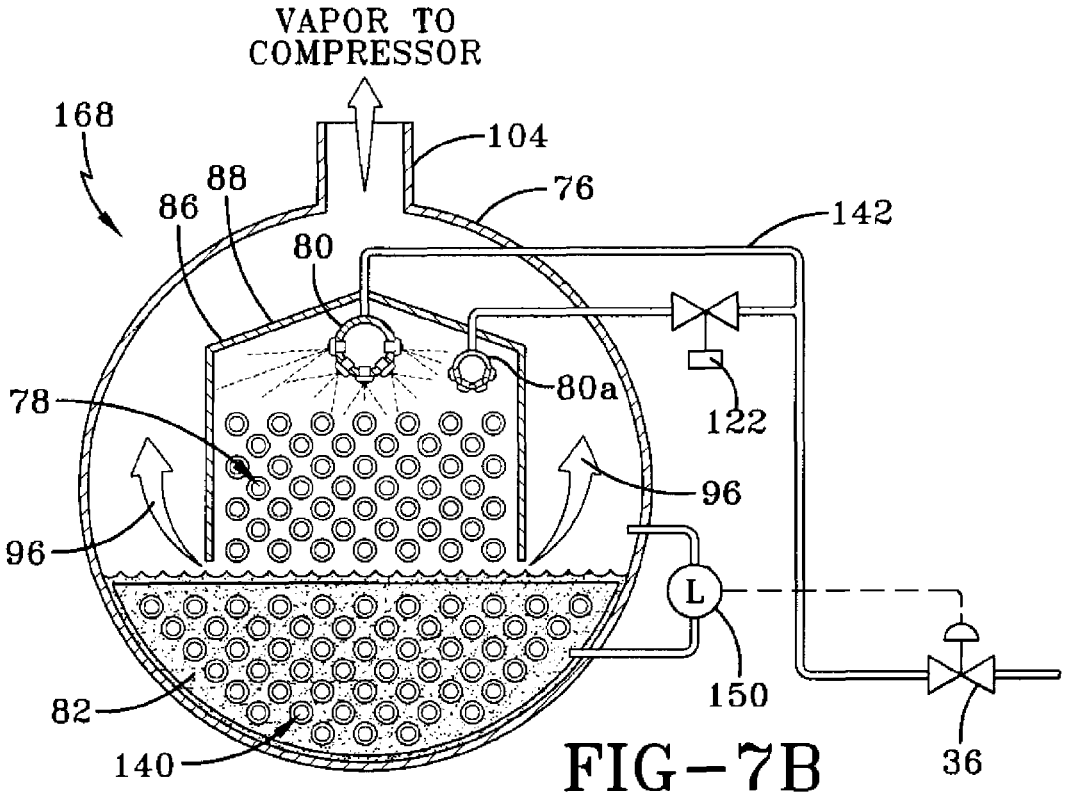
FIG. 7B shows a cross section of yet another exemplary evaporator having a distributor connected to the additional refrigerant distribution supply line.

FIG. 7A illustrates an exemplary embodiment of evaporator 168. Evaporator receives refrigerant through supply line 142 and supply line 144. Supply line 142 and supply line 144 are bifurcated at a control device 122. Supply line 142 and supply line 144 penetrate hood 86 at upper end 88 to dispense refrigerant over tube bundle 78. Evaporator 168 includes a downwardly opening hood 86 that substantially surrounds and covers tube bundle 78. FIG. 7A shows expansion device 36 controlled by sensor. Supply line 142 dispenses refrigerant via distributor 80. Supply line 144 is a an additional supply that provides an additional distribution device to dispense liquid refrigerant over tube bundle 78. Supply line 144 may be controlled by control device 122, for example, a control valve. Control device 122 may substantially open fully in response to a drop in the refrigerant level in evaporator 168, as sensed by a level sensor 150 to provide more refrigerant from condenser. Control device 122 opens when expansion device 36 is open and liquid refrigerant level 82 continues to decrease. Level sensor 150 senses when a predetermined low refrigerant level in evaporator 168 has been reached and then transmits a signal that causes control device 122 to open and supply refrigerant to evaporator 168 through supply line 144. Level sensor 150 is an exemplary means for determining low refrigerant. Other means may be employed for determining low evaporator refrigerant, including but not limited to, for examples, high refrigerant level in condenser 34, increased head pressure on system 14, or a high degree of subcooling. When the refrigerant level in evaporator 168 is above the predetermined level, control device 122 is in a closed position, preventing refrigerant flow in supply line 144. An alternative embodiment of evaporator 168 is shown in FIG. 7B. In the alternative embodiment of FIG. 7B supply line 144 is connected to a distributor 80*a* to distribute refrigerant over tube bundle 78. In an exemplary embodiment, distributor 80*a* may include one or more low pressure nozzles. In another exemplary embodiment, supply line 144 may provide refrigerant directly to the reservoir of liquid refrigerant 82, or to other locations in tube bundles 78, 140.

Figure 8:
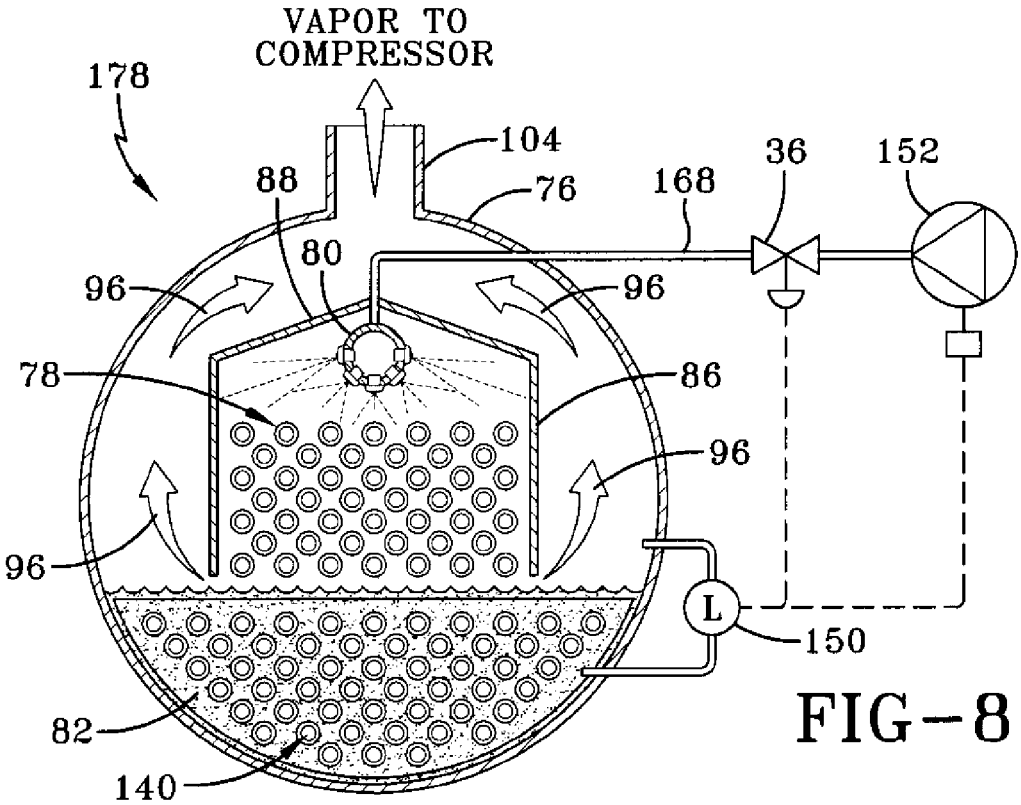
FIG. 8 shows an exemplary evaporator having a booster pump connected thereto.

FIG. 8 illustrates an exemplary embodiment of evaporator 178. Evaporator 178 includes downwardly opening hood 86 that surrounds and covers tube bundle 78. Tube bundle 78 receives refrigerant from distributor 80. Tube bundle 140 is located at least partially beneath tube bundle 78. Tube bundle 140 boils liquid refrigerant that collects at the bottom of evaporator 178 in pool of liquid refrigerant 82. A booster pump 152 can receive liquid refrigerant from a condenser or from an intermediate vessel such as an intercooler or a flash tank. Booster pump 152 may be actuated in response to sensing a head pressure in system 14, which is lower than a predetermined head pressure value. Booster pump 152 may be operable at variable speeds. Booster pump 152 may also be actuated on or off in response to a decrease in the refrigerant level in evaporator 178, as sensed by level sensor 150, when expansion device 36 is in a fully open position. Each of the evaporator embodiments shown in FIGS. 7A, 7B and 8 may be arranged with only first tube bundle 78, that is, in the absence of tube bundle 140, as shown in FIGS. 6A and 6B.

Figure 9:
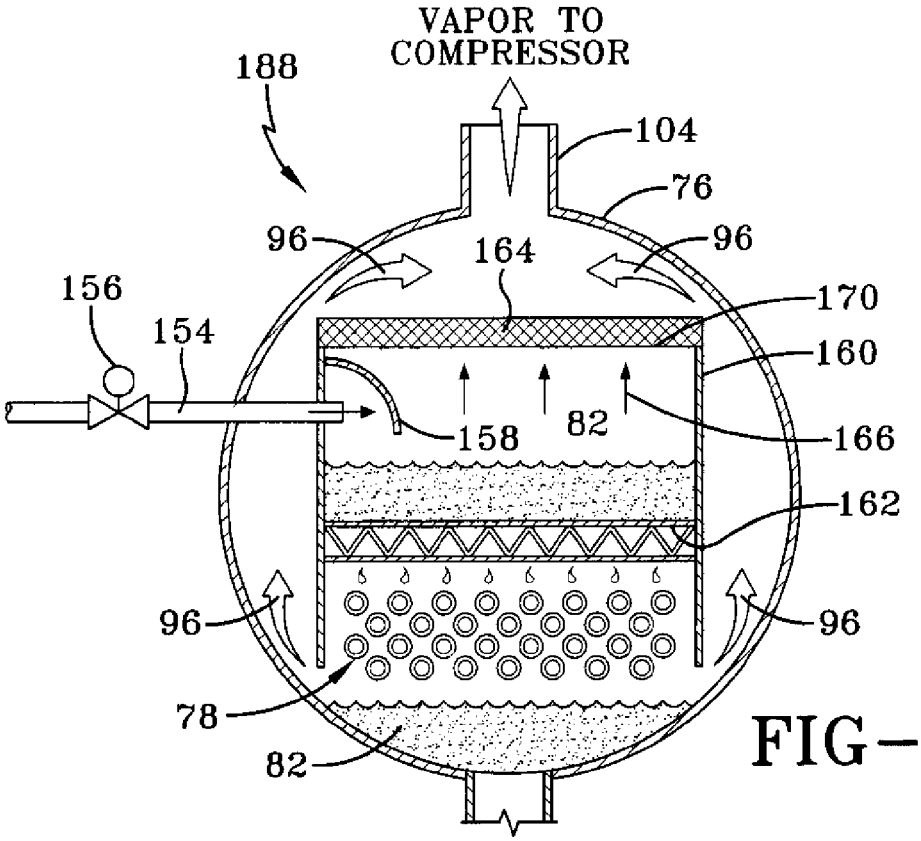
FIG. 9 shows an exemplary evaporator having a deflector in an internal enclosure for redirecting refrigerant.

FIG. 9 illustrates another exemplary embodiment of an evaporator 188. Evaporator 188 includes a refrigerant inlet line 154 that directs flow of a two-phase refrigerant that is, liquid and vapor refrigerant, through shell 76 and into an internal enclosure 160. Flow of the two-phase refrigerant into enclosure 160 may be controlled by an expansion device 156. A baffle or deflector 158 is positioned within enclosure 160 to direct the inward flow of refrigerant downward in enclosure 160. In an exemplary embodiment, deflector 158 may be, for example, a downwardly curved protrusion extending from a wall of enclosure 160. Enclosure 160 includes a distributor 162. Distributor 162 permits liquid refrigerant collected in enclosure 160 to travel from enclosure 160 to tube bundle 78. Liquid refrigerant 82 may accumulate in enclosure 76, which is removed via a drain pipe as described above with respect to FIGS. 6B and 6C. Distributor 162 can be a perforated sheet or other structural element or device that can provide a regulated flow of liquid from enclosure 160. Upper end 170 of enclosure 160 allows vapor refrigerant 166 in enclosure 160 to flow from enclosure 160 into outlet 104, while vapor refrigerant 96 generated through heat transfer with tube bundle 78 follows a path around sidewalls of enclosure 160. In an exemplary embodiment, upper end 170 may be a mesh structure 164.

While only certain features and embodiments of the invention have been shown and described, many modifications and changes may occur to those skilled in the art (for example, variations in sizes, dimensions, structures, shapes and proportions of the various elements, values of parameters (for example, temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (that is, those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A vapor compression system comprising:

a compressor, a condenser, an expansion device and an evaporator connected by a refrigerant line;

the evaporator comprising:

a shell;

a first tube bundle;

a hood;

a distributor;

a first supply line;

a second supply line;

a valve positioned in the second supply line; and a sensor;

wherein the first tube bundle comprises a plurality of tubes extending substantially horizontally in the shell;

wherein the distributor is positioned above the first tube bundle;

wherein the hood covers the first tube bundle;

wherein the first supply line is connected to the distributor and an end of the second supply line is positioned near the hood;

wherein the sensor is configured and positioned to sense a level of liquid refrigerant in the shell; and wherein the valve is configured and positioned to regulate flow in the second supply line in response to a sensed level of liquid refrigerant from the level sensor.

2. The system of claim 1, further comprising:

a second tube bundle and a gap separating the first tube bundle and the second tube bundle.

3. The system of claim 2, wherein the first tube bundle is at least partially above the second tube bundle.

4. The system of claim 2, wherein the hood extends toward the gap and terminates near the gap.

5. The system of claim 2, wherein the second tube bundle comprises a plurality of tubes extending substantially horizontally in the shell.

6. The system of claim 1, wherein the end of the second supply line is configured and positioned to dispense refrigerant over the first tube bundle.

7. The system of claim 1, wherein the valve is opened in response to the expansion device being in an open position and the sensed level of liquid refrigerant is less than a predetermined level.

8. The system of claim 7, wherein the valve is closed in response to when the sensed level of liquid refrigerant is greater than the predetermined level the to prevent flow in the second supply line.

9. The system of claim 1, further comprises a second distributor positioned above the first tube bundle and is connected to the second supply line to distribute refrigerant over the first tube bundle.

10. The system of claim 9, wherein the second distributor comprises a low pressure nozzle.

* * * * *